United States Patent [19]

Waikas et al.

[11] Patent Number: 4,491,164

[45] Date of Patent: Jan. 1, 1985

[54] IMPACT DRIVEN WOOD SPLITTER

[75] Inventors: Jack Waikas, Hyde Park; James Hosie, Staatsburg, both of N.Y.

[73] Assignee: Waikas & Hosie Development Corporation, White Plains, N.Y.

[21] Appl. No.: 415,393

[22] Filed: Sep. 7, 1982

[51] Int. Cl.[3] ..... B27L 7/00

[52] U.S. Cl. ..... 144/194; 144/366; 173/123

[58] Field of Search ..... 144/193 R, 194; 173/123

[56] References Cited

U.S. PATENT DOCUMENTS

| | | | |
|---|---|---|---|
| 3,670,789 | 6/1972 | Long | 144/194 |
| 4,211,265 | 7/1980 | Thackery | 144/193 R |
| 4,315,534 | 2/1982 | Blackstone | 144/194 |
| 4,318,446 | 3/1982 | Livespy | 173/123 |
| 4,403,635 | 9/1983 | York | 144/194 |

FOREIGN PATENT DOCUMENTS

| | | | |
|---|---|---|---|
| 2073656 | 10/1981 | United Kingdom | 144/194 |

*Primary Examiner*—W. D. Bray

*Attorney, Agent, or Firm*—Martin J. Spellman, Jr.

[57] ABSTRACT

This invention comprises a portable impact driven log cone splitter mounted to a power source such as a chain saw power unit. The wood or log splitter is coupled to a chain saw power unit through an appropriate gearing arrangement in one preferred embodiment. The blade is removed from the conventional power saw unit and the wood splitter is readily mounted thereto in an orientation having a hollow splitting screw cone with a starter tip parallel to the longitudinal axis of the unit. The cone is mounted over an impact drive unit which is coupled to the gearing arrangement to provide a safe reliable drive. This arrangement also permits a portable log splitting unit which is relatively inexpensive and simple to use and with the cone removed permits use as an impact tool.

6 Claims, 4 Drawing Figures

IMPACT DRIVEN WOOD SPLITTER

SUMMARY OF THE INVENTION

This invention relates to wood splitters and particularly to log cone splitters driven by an impact tool mounted on a portable power source such as a chain saw arrangement. The invention comprises a replaceable starter tip mounted to a splitting screw cone which, in turn, is coupled through an impact drive unit to an appropriate gearing arrangement on the power source. The cone includes a hollow internal portion having the impact drive unit mounted therein with a suitable coupling extending outwardly from the drive unit for connection to the gearing arrangement. The gear box is mounted to the chain drive on a conventional chain saw arrangement in one embodiment with the axis of the cone oriented parallel to the longitudinal axis of the chain saw power or in other words, extending in the same direction as the blade when attached to the unit. This design permits a compact portable unit wherein the impact tool prevents turning or movement of the logs which occurs on other units creating a safety hazard.

Accordingly, an object of this invention is to provide a new and improved wood splitter.

Another object of this invention is to provide an impact driven wood splitter of a portable nature.

A further object of this invention is to provide a new and improved log cone splitter driven by a portable power source through an impact drive unit.

A more specific object is to provide a new and improved portable log splitter having a wood splitting cone mounted on an impact drive unit which is coupled to a chain saw power source with the cone oriented parallel to the longitudinal axis of the chain saw power source to form a compact portable unit and which is convertible into a portable impact tool by removal of the cone.

BACKGROUND OF THE INVENTION

The present invention relates to a wood splitting unit and particularly to a portable gas powered impact driven tool for splitting logs which is mounted on a power saw unit.

Among the more pertinent prior art is U.S. Pat. No. 4,188,987 to James which discloses a cone splitter carried on a splined shaft which runs perpendicular to the longitudinal axis of the unit and which appears to be very awkward to use. In addition to the James patent, there are also commercially available log cone splitters which are coupled to the wheel hub on vehicles and are driven thereby. Such splitters are not portable and are extremely dangerous to use.

U.S. Pat. No. 4,252,166 to Kozicki discloses a log splitter using two oppositely rotating augers driven by a power source through a gear reduction arrangement. This patent is merely of a background interest but it does show a portable unit. U.S. Pat. No. 65,303 to Tilton shows an early reciprocating wood splitter with a cam arrangement operated by hand.

Also of background interest are U.S. Pat. No. 3,371,724 to Crowell which discloses a power wedge and U.S. Pat. No. 3,160,217 to Raihle which discloses a mechanical hammer. Other prior art patents may, of course, exist and be pertinent since the above listing is not intended to be all inclusive but such patents are not believed to affect the patentability of the invention.

While the prior art discloses certain features which are relevant to the present invention, the patents do not disclose the particular threaded cone log splitter driven by an impact tool mechanism. There is also no disclosure of a log splitter driven by a chain saw power unit with the axis of the cone in the same orientation as the conventional blade. The wood splitting unit is readily adapted to a chain saw unit or other portable drive and hence is portable, easy to use and relatively inexpensive. The cone may also be removed and the arrangement will function as a portable impact tool.

BRIEF DESCRIPTION OF THE DRAWINGS

The above and other objects and advantages of the present invention will be more clearly seen when viewed in conjunction with the accompanying drawings wherein.

DETAILED DESCRIPTION OF THE INVENTION

Figure 1:
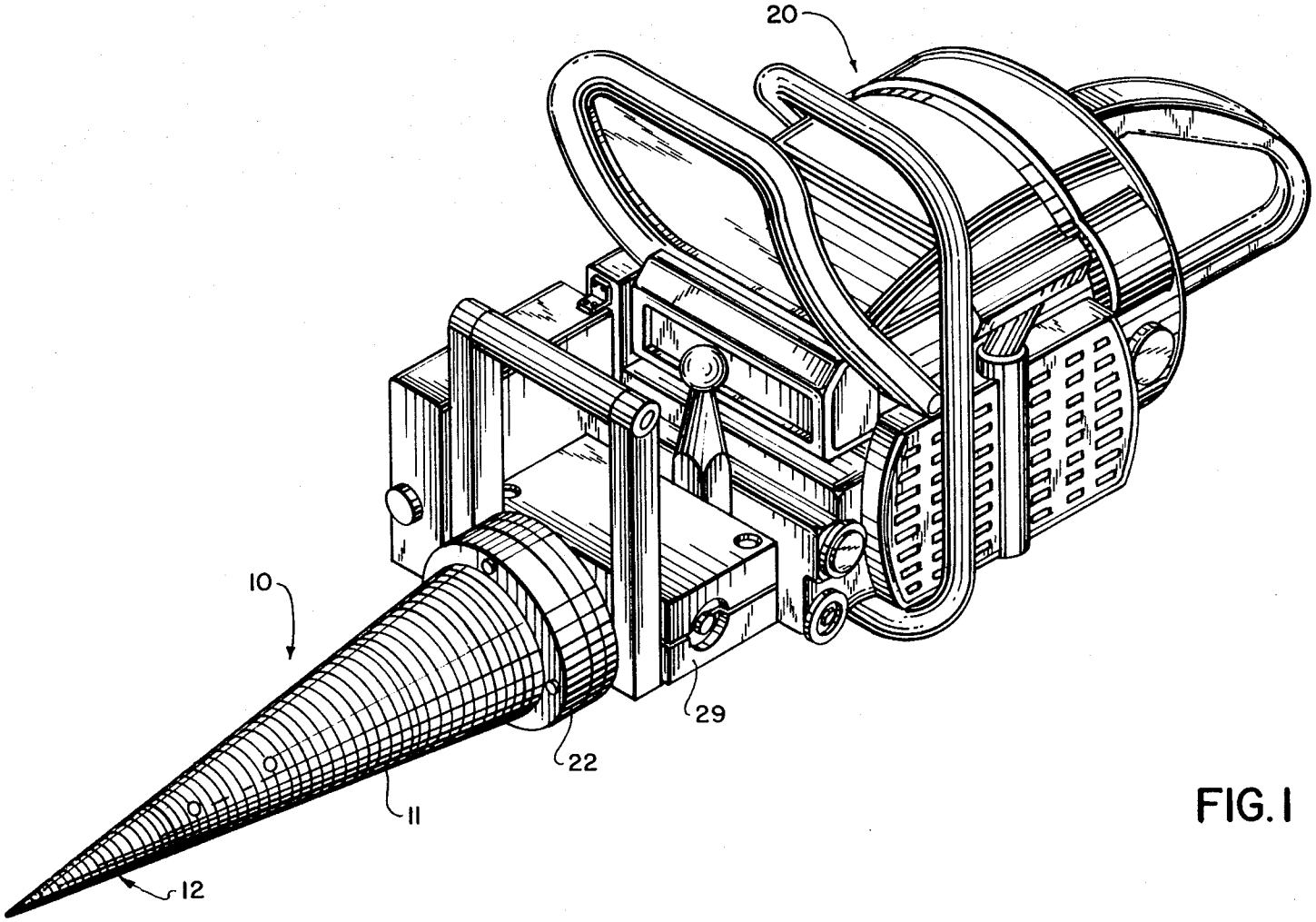
FIG. 1 is a perspective view of the impact driven wood splitter comprising the invention.
Figure 2:
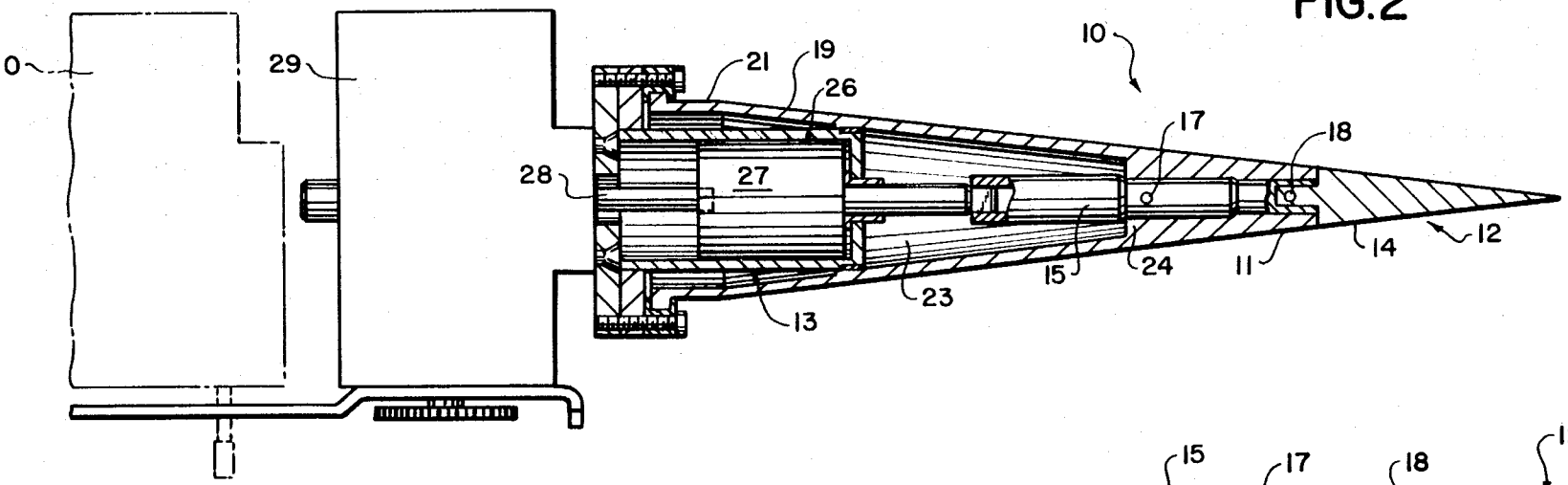
FIG. 2 is a partial cross-sectional view illustrating the log splitting attachment which is mounted to the chain saw.
Figure 3:
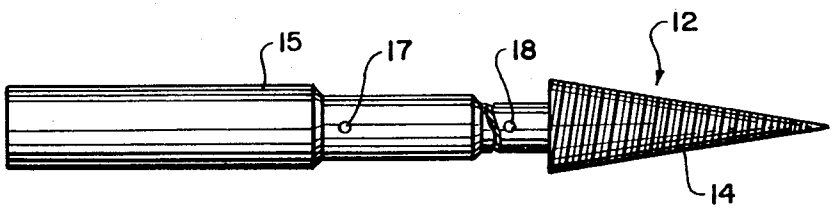
FIG. 3 is a side view showing the starter tip which is coupled to the log splitting cone.
Figure 4:
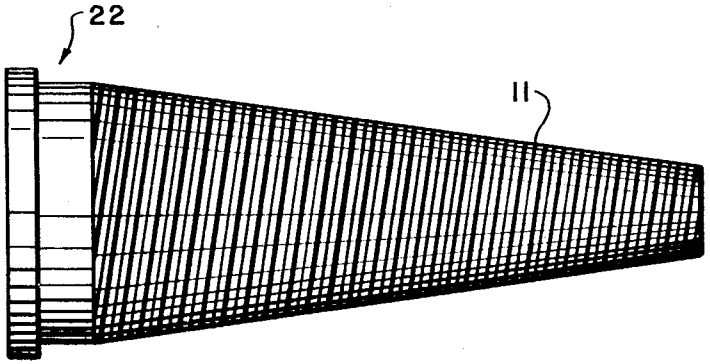
FIG. 4 is a side view of the log splitting cone of FIG. 1.

Referring now to the drawings, the invention comprises a wood splitting unit 10 mounted to a chain saw unit 20 and driven thereby. While a chain saw unit 20 is shown in FIG. 1, other portable power sources are similarly suitable and may be used pursuant to the teachings of the invention. The wood splitting unit 10 includes a splitting screw cone 11 having a replaceable starter tip 12 at the lead end thereof. The wood splitting unit 10 is rotatably driven by the chain saw unit 20 into a log causing it to split as the thicker portion of the splitting screw cone 11 engages and spreads the log apart into sections. In the present invention, the wood splitting unit 10 includes an impact tool 13 which prevents the logs from turning during splitting adding a high degree of safety and efficiency to a portable unit.

In the wood splitting unit 10, the starter tip 12 is made of tungsten carbide material and includes a pointed threaded portion having a threaded exterior 14 and a shaft 15 extending rearwardly therefrom to engage the impact drive shaft 16. Removable pins 17 and 18 extend transversely through one side of the splitting screw cone 11 and against the shaft 15 to hold the splitting screw cone 11 in position as it rides on the shaft 15 of the impact driven starter tip 12.

The hollow splitting screw cone 11 has a threaded exterior body portion 19 which tapers outwardly from the tip 12 to a cylindrical shaft portion 21. A flanged stop 30 extends outwardly from the cylindrical portion 21 and is mounted within the collar 22. The precision shaped splitting screw cone 11 is free to rotate within the collar 22 with the use of bearings. The hollow splitting screw cone 11 also includes an internal aperture 23 of decreasing diameter terminating in a forward recess 24 of a relatively small cross-section to accommodate the forward portion of shaft 15 which is coupled to the impact drive unit 13. The impact tool or unit 13 is mounted within the aperture 23 and is fixed to the shaft 15 by a coupling arrangement joining the impact drive shaft 16 thereto.

The impact drive unit 13 is a commerically available device and hence is not described in detail. A typical unit 13 would include a housing 26 within which a substantially cylindrical element 27 spins under urging from the impact rotor drive shaft 28 as the splitting screw cone 11 engages a log (not shown). The impact tool 13 is coupled to the gear box 29 by the rearwardly extending shaft 28. Since the impact drive unit 13 extends longitudinally within the cone aperture 23, the wood splitting unit 10 is rather compact and portable.

The chain saw unit 20 comprises a conventional commercial unit with the blade removed. The chain saw drive is connected to the gear box 29 by a chain driven gear (not shown) after the blade has been removed. The splitting screw cone 11 is mounted parallel to the longitudinal axis of the chain saw unit 20, that is, parallel to where the blade would be normally located. The arrangement thus provides a reasonable and safe alternative to the devices disclosed in the prior art as discussed herein. It is also much easier to handle a log splitter having the splitting element or cone arranged in the aforesaid position.

The use of a chain saw unit 20 is one preferred embodiment of the invention but any portable power source could be used in conjunction with the wood splitting unit 10 which includes an impact tool 13. Furthermore, the invention may also function as a pure impact tool with any power source if the cone 11 and starter tip 12 are removed leaving the drive shaft 16 free to perform various operations.

It is understood that the above-described arrangements are merely illustrative examples of the application. Numerous other arrangements may be readily devised by those skilled in the art which will embody the principles of the invention and fall within the spirit and scope thereof.

We claim:

1. An impact driven wood splitter comprising:
a threaded cone for engaging and splitting wood,
an impact drive unit coupled to said cone to impart rotational movement thereto,
a gear system connected to said impact drive unit, and,
a portable power source having means coupled to the gear system to drive said system, said cone being oriented parallel to the longitudinal axis of the power source and wherein the impact drive unit prevents turning of the wood being split.

2. A wood splitter in accordance with claim 1 wherein:
said threaded cone further includes a replaceable starter tip having a pointed lead portion, a threaded intermediate body and a rear shaft, said rear shaft being coupled to said impact drive unit to be driven thereby, and,
said cone includes a main body portion having a threaded exterior surface extending rearwardly from the tip and being mounted to said rear shaft.

3. A wood splitter in accordance with claim 1 wherein:
sais cone includes a rear recess in said main body portion having the impact drive unit mounted therein and a rear flange extending circumferentially thereabout adjacent said gear system.

4. A wood splitter in accordance with claim 3 further including:
a collar mounted about the rear of said cone and connecting said cone to the gear system for rotational movement.

5. A log splitting attachment for use with a chain saw power unit having an output drive shaft coupled to the chain drive, said invention comprising:
A threaded cone for engaging and splitting logs and having an internal rear recess
an impact drive unit mounted within the recess in the cone and coupled thereto to impart controlled rotational movement to the cone, and,
a gear system coupled to said impact drive unit and to said output shaft from said chain saw to drive said threaded cone upon activation of said chain saw unit, said cone being oriented parallel to said longitudinal axis of said chain saw unit to provide a compact unit.

6. A log splitting attachment in accordance with claim 5 further including:
a replaceable starter tip having a pointed lead portion, a threaded intermediate body, and a rear shaft removably mounted to said cone, wherein
said cone includes a main externally threaded body portion, said body portion including a recess at its forward end to engage said rear shaft of said starter tip, said internal recess including inwardly tapering wall portions and a forward cavity which accommodates said rear shaft, said rear shaft being coupled to said impact drive unit.

* * * * *